United States Patent [19]

Hepp

[11] Patent Number: 4,593,825

[45] Date of Patent: Jun. 10, 1986

[54] ADJUSTABLE KNOCKDOWN TRAY ASSEMBLY

[76] Inventor: James Hepp, 5 Fairview La., Glen Cove, N.Y. 11542

[21] Appl. No.: 742,415

[22] Filed: Jun. 7, 1985

[51] Int. Cl.[4] ..... A47F 3/14

[52] U.S. Cl. ..... 211/126; 211/194; 211/133; 40/606

[58] Field of Search ..... 211/133, 126, 188, 194; 52/630, 291, 664; 206/509, 511, 512; 40/606, 607, 124.1, 124; 108/91, 111

[56] References Cited

U.S. PATENT DOCUMENTS

| | | | |
|---|---|---|---|
| 2,838,198 | 6/1958 | Vidal | 211/126 X |
| 3,204,778 | 9/1965 | Nawman et al. | 211/126 |
| 3,426,913 | 2/1969 | Abatiell, Jr. | 211/194 |
| 3,481,507 | 12/1969 | Sanders | 211/126 X |
| 3,490,602 | 1/1970 | Wentzel | 211/126 |

*Primary Examiner*—Ramon S. Britts
*Assistant Examiner*—Sarah A. Lechok Eley
*Attorney, Agent, or Firm*—A. A. Saffitz

[57] ABSTRACT

A knockdown tray assembly which is capable of supporting heavy loads, using paperboard or cardboard trays and supporting members. The tray supporting members are of a new construction and are formed of inverted U-shaped beams which are provided at the center of each beam with interfitting pivot structure. The interfitting pivot structure is formed by providing a pin in a shallow wall molding on the bottom U-beam and a socket which has a much greater elevation on the upper U-beam, the shallow beam and deep socket improving the stability of the interfitting pivot portion of the beams thereby preventing any unintended disengagement of the pivot and socket element. Also trays are utilized in which the circular openings are ordinarily provided within the corners and at the bottom of each tray to accommodate the circular posts are modified to provide trays which are relatively long. The placement of the circular openings for the sockets is determined by the dimensions of the interfitted U-beams. Thus, each tray has a shelf portion which can extend beyond the posts on each end and thereby adapt the tray assembly for a display tray. Also the display trays in the assembled relationship can be connected to provide a vertical post for supporting a sign at the center of the display.

7 Claims, 19 Drawing Figures

120
122
126
127
128
130
131
132
136
138
140
142
147
152
153
156

120
122
124
126
130
131
132
136
138
140
142
143
146
147
152
153
156
163

Fig. 8
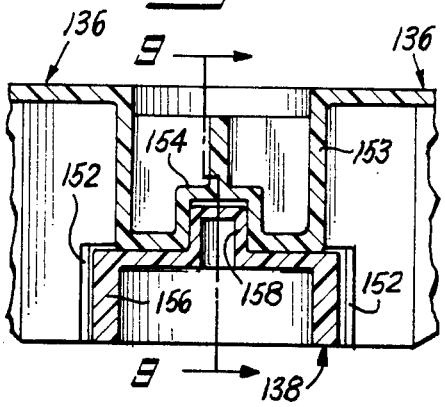
Fig. 7
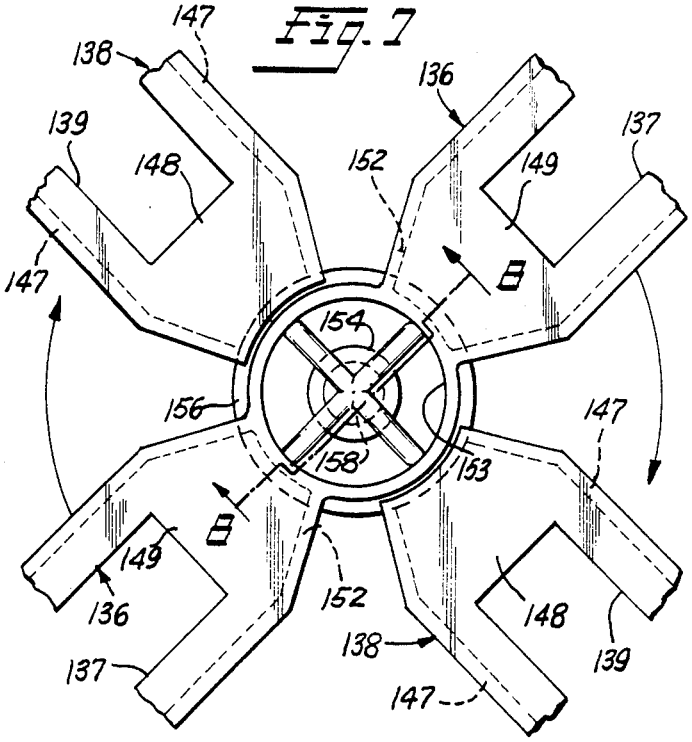
Fig. 9
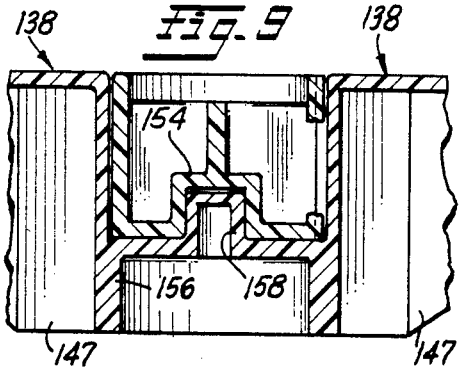
Fig. 11
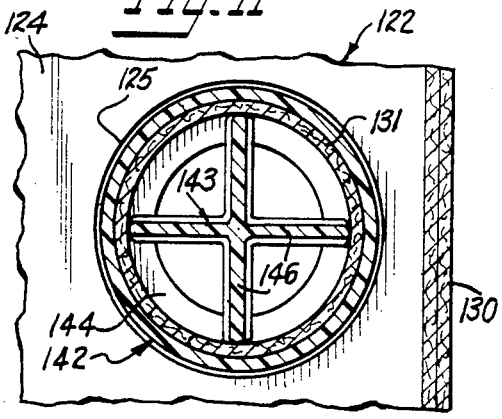
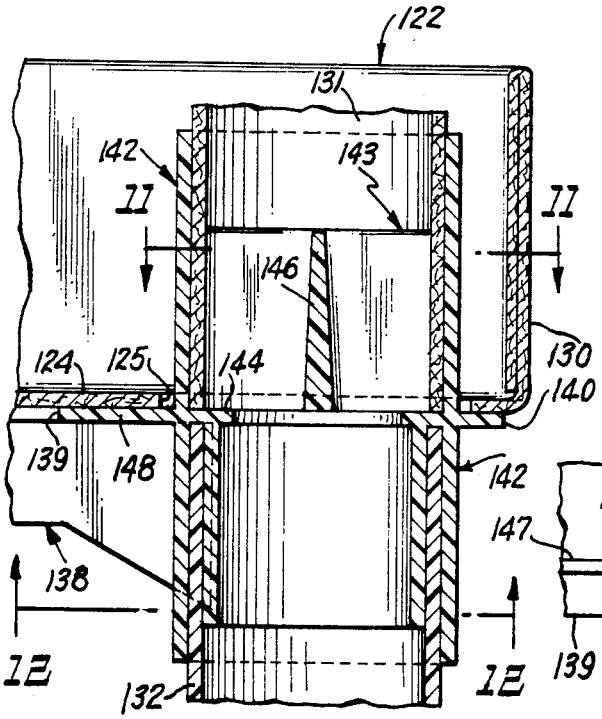
Fig. 10
Fig. 12
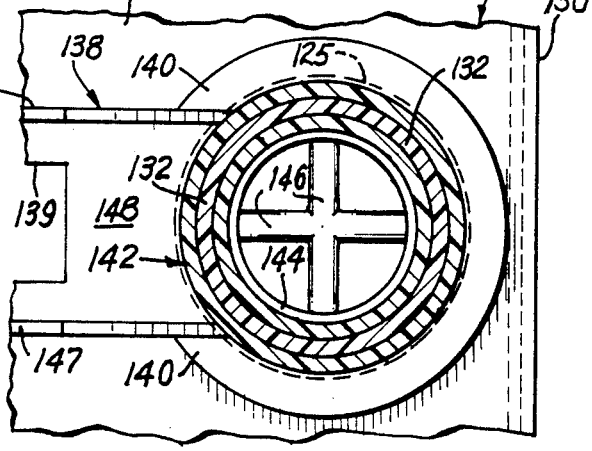

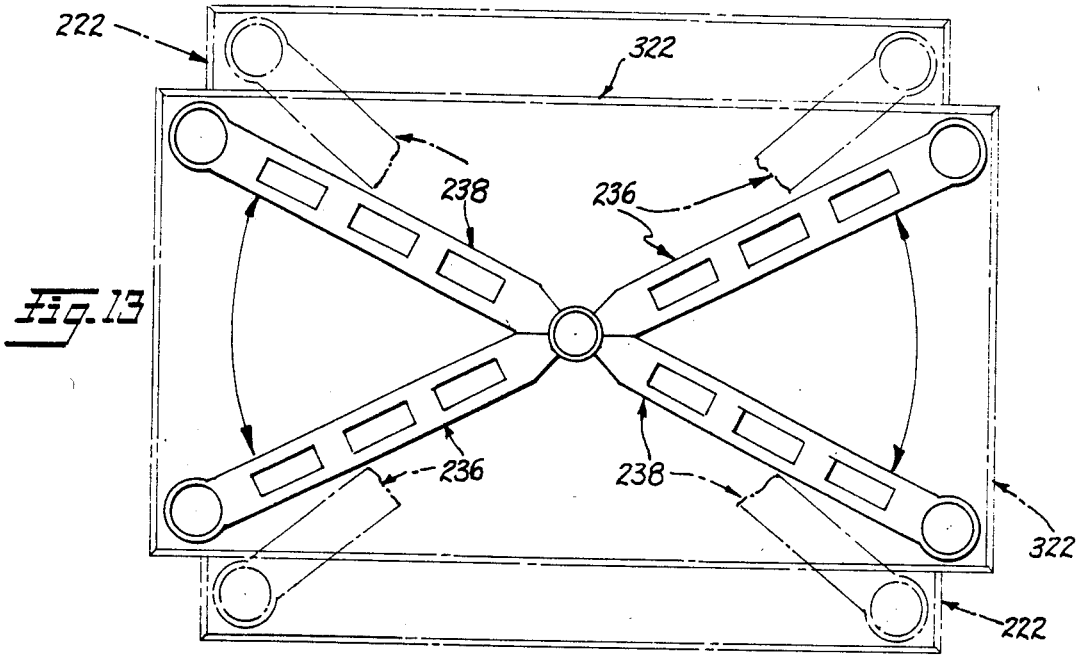
Fig. 13
Fig. 14
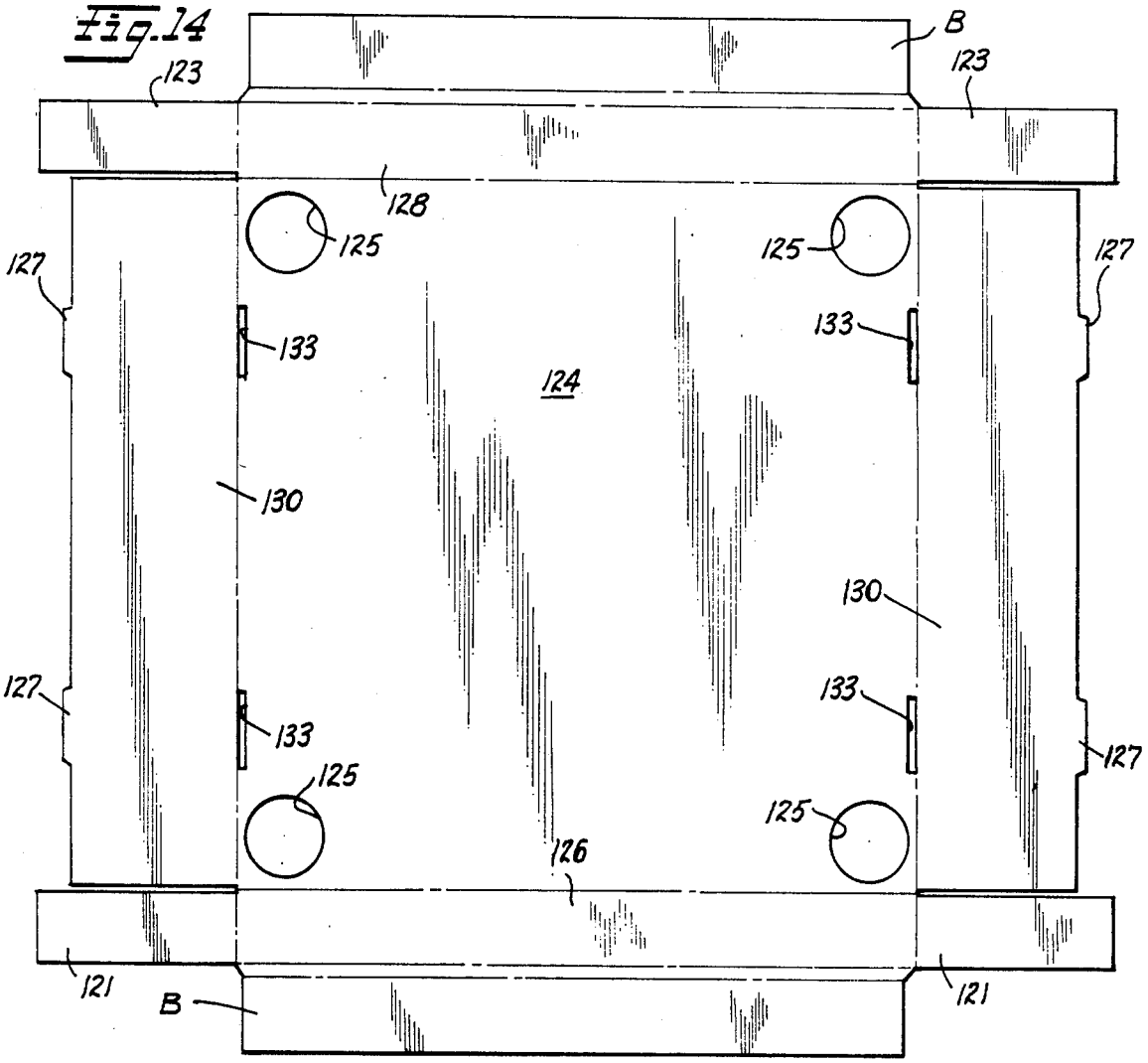

ADJUSTABLE KNOCKDOWN TRAY ASSEMBLY

CROSS-REFERENCE TO RELATED APPLICATIONS

This application is an improvement in the beam structure and in the pivot structure of my co-pending application, Ser. No. 639,045, filed Aug. 9, 1984, entitled "Adjustable Knockdown Tray Assembly" incorporated herein by reference.

BACKGROUND OF THE INVENTION

1. Field of the Invention

The field of the invention is in low-cost knockdown shelf systems in which trays formed of low-cost paperboard or fiberboard material are supported by tubular posts and by support members underlying the trays.

2. Description of the Prior Art

My prior patent, Hepp, U.S. Pat. No. 4,428,487, shows a sectional display in which angular corner posts engage grooved portions on the underside of plastic trays. In order to achieve alignment at the four corners in a vertical assembly of three to five shelves of the rack, a plurality of rib portions are provided to assure engagement and locking of the corners. The construction is very sturdy but does not meet the need of a low-cost rack which is used mainly for storing rather than for display but which still is capable of supporting heavy loads and does not require the use of relatively expensive molded plastic, wood, or metal for the construction of the trays or shelves.

Paper trays are known for use in shelf storage and handling systems, for example, a paperboard tray constructed of a single blank used in handling and sorting mail, is shown in Pfaffendorf, et al, U.S. Pat. No. 3,784,083. However, such paperboard trays have not been herefore used in an assembly in the type in my prior U.S. Pat. No. 4,428,487.

Nawman, et al, U.S. Pat. No. 3,172,542 shows a tray having a paper bottom which is reinforced by a cross brace.

Wentzel, U.S. Pat. No. 3,490,702, describes a disposable paper tray in which the bottom panel is made of paperboard and is reinforced by cross braces.

DISTINCTIONS OF THE INVENTION OVER THE PRIOR ART

None of the prior parents show inverted U-beams used in a pivot arrangement as specifically shown and described herein with a critical ratio of socket height to pin height. Also the prior art does not show paperboard trays having registry holes punched to adapt the X cross bracing supports for supporting the trays wherein the trays have a shelf extending from the support posts on both sides.

Although my prior co-pending application, Ser. No. 639,045 shows a similar T-beam brace for engaging corner sockets in trays, the present assembly is far stronger and supports substantially greater loads of articles for storage or for display.

OBJECTS OF THE INVENTION

An object of the invention is to provide interfitting U-beam reinforcing elements which are formed at the centers to pivot and which accommodate different sized trays in a knockdown tray assembly for storage or for display.

Another object is to provide an easily assembled display stand having a vertical post for a sign.

Other objects will be seen from the following detailed description, drawings and claims.

SUMMARY OF THE INVENTION

The present invention relates to a knockdown assembly comprising an adjustable U-beam pivoting assembly which is adjusted to support rectangular trays by simply pivoting the two U-beam elements which are formed at the center of each of the beams to provide a pin and socket pivot so that the trays which are supported can be placed in a variety of sizes varying from broad trays to narrow trays within the same longitudinal dimensions. The knockdown assembly is put together by bringing the two U-beam members together to engage each center of the corresponding U-beam at the pivot point by the corresponding pin and socket elements respectively and by using the cylindrical socket portions which are formed at the corners of the U-beam to provide a vertical stand by means of an interfitting sleeve and socket arrangement which is structurally provided at the ends of the U-beam supporting members.

In my companion co-pending application, Ser. No. 639,045, filed Aug. 9, 1984, entitled "Adjustable Knockdown Tray Assembly" I have described and claimed two T-beam adjustable members which are constructed to pivot in a totally different modification than in the present invention, namely: the pivot in the companion co-pending application, Ser. No. 639,045 is shown on the upper T-shaped arm by forming a pin member projecting from a hollow portion within the rib of the T-member at the center thereof to permit the pin to enter a cylindrical boss in the lower T-shaped arm. Part of the difficulty which is encountered in the operation of the pivot during the use of the reinforcing cross bracing adjustable T-beam members of my co-pending application Ser. No. 639,045 lies in the characteristic of unintended separation wherein the lower pin can fall out in the event that the pivot pin is reversed from its upper arm position to the lower arm position and the boss is reversed to the upper arm position. This possibility of accidental disengagement of the two arms is specifically mentioned in my prior patent application. In the U-shaped construction of the present invention this "reversal of parts" accidental disengagement is not encountered and a more positive engagement at the pivot center is provided due to the present construction.

The U-beam construction of the present invention is one which uses the bottom of the U as the top of the beam so that the edges of the supporting beam which underly the tray and serves to reinforce the tray by diagonal beam supports is provided with a downward flange at the edges of the beam. This beam construction is in contrast to the T-beam construction. The improvement in load bearing capacity of this U-beam construction is believed to result because of the improvement in the stability of the pivoting center which is characteristic of the novel pivoting construction in the invention. Comparison with the pivoting construction in co-pending application, Ser. No. 639,045 reveals that the tight fitting of the two beam members by having the indented portions away from the pivot touch each other when the members are brought to the narrowest configuration as shown in FIG. 14 of the co-pending application creates the possibility that the upper beam member may be dislodged from the lower beam member. To prevent this dislodgement ribs 76 are provided adjacent the inwardly indented portions of the pivot. These ribs 76 are not needed in the present invention because a totally different pivot construction is available in the improvement permitted by the U-beam members.

Although similarly indented to create a circular pivot portion for the upper beam member and lower beam member respectively, an outstanding feature of the present pivot construction lies in the proportion of the interfitting pivot construction represented by the upper U-beam relative to the height of the lower U-beam. Specifically the height of the upper U-beam portion of the pivot part of the U-beam is twice the height of the lower beam portion. As a result, the wall which represents one third of the total pivot assembly height has a projecting pin provided at the center which engages a correspondingly shaped recess portion which is formed from the upper beam section. With this construction and with the fact that the outer diameter of the beam supporting portion of the pivot in this central section is substantially greater than the outer diameters of the recessed portion there is achieved an additional section of supporting structure within the pivot assembly itself.

Because of these several advantages flowing from the novel pivot assembly construction and from the U-beam construction there is achieved a far greater load carrying capacity than would be expected from the assembly of various beam shapes. About 25% greater load can be carried in the storage systems represented by the assembly of the adjustable reinforcing elements and paperboard trays.

BRIEF DESCRIPTION OF THE DRAWINGS

FIG. 7 is a fragmentary top view of the pivotal connection of the storage tray supporting arms;

FIG. 8 is a fragmentary vertical sectional view through the pivotal connection, taken on the line 8—8 of FIG. 7;

FIG. 9 is a fragmentary vertical section, similar to FIG. 8, taken on the line 9—9 of FIG. 8;

FIG. 10 is an enlarged fragmentary vertical sectional view, through one of the tray supporting posts, taken on the line 10—10 of FIG. 3;

FIG. 11 is a fragmentary horizontal sectional view, taken on the line 11—11 of FIG. 10;

FIG. 12 is a fragmentary horizontal sectional view, taken on the line 12—12 of FIG. 10;

FIG. 13 is a diagrammatic plan view, showing the adjustment of the support arms for various tray sizes; and FIG. 14 is a pattern blank for the tray shown in FIG. 3.

DESCRIPTION OF THE PREFERRED EMBODIMENTS

Figure 2:
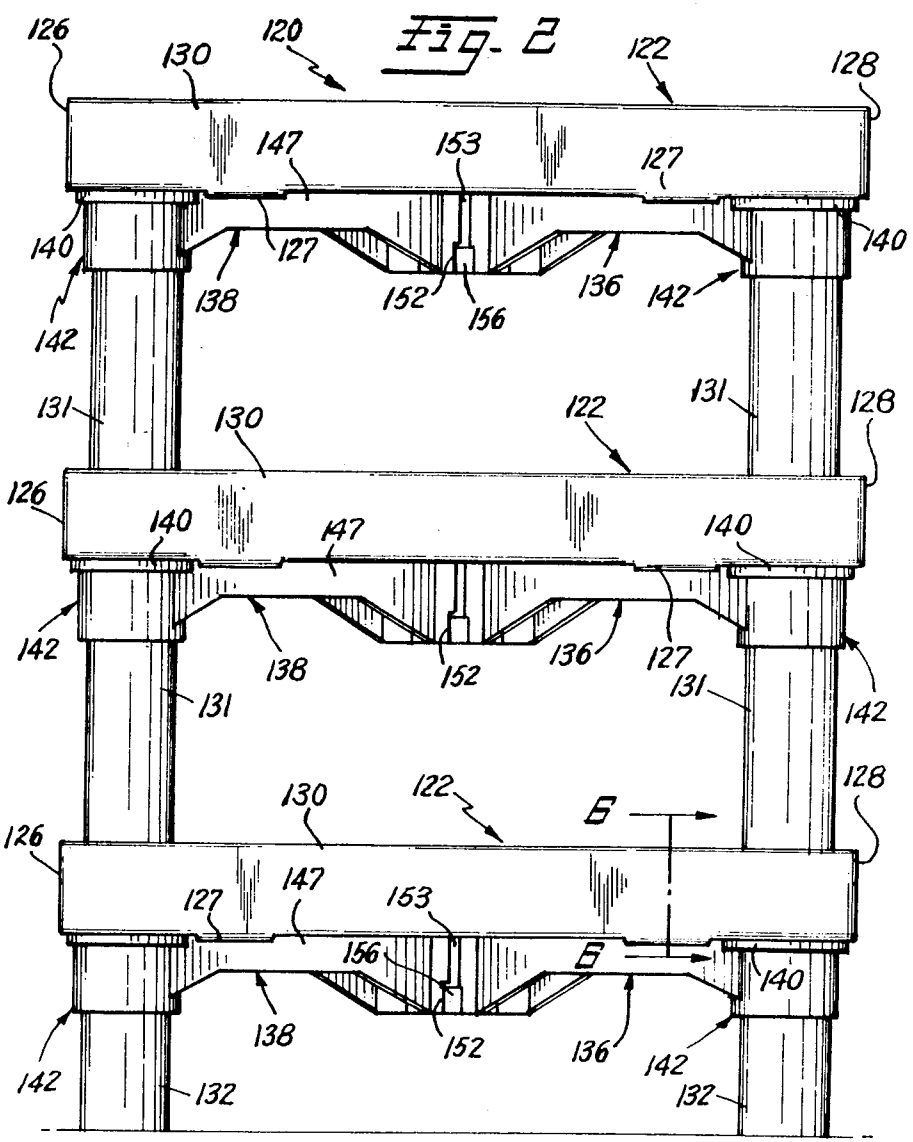
FIG. 2 is a side elevational view of the storage tray assembly of FIG. 1 as viewed from the right thereof.

The preferred embodiments in the present invention comprise two classes of tray assemblies, a first class of tray assembly 120 shown in FIGS. 1-14 in which the primary purpose of the assembly is for the storage of heavy objects and the second tray assembly 320 for the additional purpose of providing trays of special dimensions adapted for heavy loads but also adapted for display, as shown in FIGS. 15-18 and having special shelf portions extending beyond the post holes which are cut out in the trays. This latter assembly 320 for display shown in FIGS. 15-18 is one which is provided with a vertical post 325 attached to the center of the arm 136 and a sign 328 or 428 which serves to identify the articles on display and to aid the visual presentation.

In FIGS. 1-4 a preferred storage tray assembly 120 is shown which comprises a plurality of horizontal rectangular trays 122 and tubular support posts 131 which are disposed at the corners within the tray so that each post 131 engages a socket 142. A corner opening is cut out in each tray which corresponds in circular diameter to the diameter of the post thereby permitting the post to pass through the opening while the socket is formed with a flange or shoulder of circular shape which permits the tray to be supported at the socket portion and with the post portion protruding. The tubular posts 131 are built up in units which define the vertical distance between the shelves or trays 122 and in the view shown in FIG. 1 a half-size post 132 is provided for the bottom which illustrates a storage tray assembly having legs to keep the bottom shelf spaced above the floor in the event that the floor becomes wet with liquid which would tend to weaken and damage the material of the paperboard trays. The tray 122 may be formed of any type of water resistant material but is preferably formed of a single blank of paperboard material or cardboard material as is shown in the pattern blank of FIG. 14.

In the preferred embodiments of the present invention using paperboard or cardboard material, no metal fasteners or plastic fasteners are used which adapts the tray for storing a variety of components and particularly electrical and magnetic materials. The corner sockets 142 have a special double socket construction as shown in FIG. 10. A spider-like partition 143 is provided which serves to limit the penetration of the post into the socket and as shown in the fragmentary horizontal section taken along line 11—11 of FIG. 10, the preferred form of the spider like partition 143 is one which has reinforcing ribs 146 in radial cruciform arrangement which centers the post 131 in the socket 142 and a shelf portion 144 in socket 142 which supports the bottom of post 131. The circular opening of the tray rests and is supported by the flange 140 which is integral with the socket 142.

It is a characteristic of the invention that the sockets 142 are integrally formed either by molding or cementing with the U-channel shaped arm 138 as seen in FIG. 12. The U-shaped channel arm 136 which is similar to 138 has openings 137 provided while U-shaped channel arm 138 has openings 139, each of the U-shaped channel arms 136 and 138 have flanges 140 on their respective arms to serve as a support for the storage trays 120 as is also shown in FIG. 12.

The nesting relationship of the water resistant, rigid tray 120 made of paperboard or cardboard material relative to the shelf portion 144 of the socket 142 which supports the tray 120 within its four corners and the reinforcing support below the tray bottom provided by the interpivoting U-shaped channel arms 136 and 138 can be better understood by referring briefly to FIGS. 13 and 14 showing the manipulation of the said channel arms 236 and 238 to accommodate different size trays which are made from a blank similar to that which is shown in FIG. 14.

In permitting the supports of different sizes of storage trays 120, the diagrammatic showing in FIG. 13 varying the angular adjustment of the U-shaped channel arms 236 and 238 is illustrated wherein a longer and narrower tray is supported for a tray which has generally square dimensions. By referring to FIG. 3 there is illustrated a tray in which the dimensions are precisely square, whereas the trays illustrated in FIG. 13 are generally square and definitely oblong and rectangular, respectively. The support arms 236 and 238 are shown in a closed scissors configuration about the interfitting pivot in FIG. 13 to bring the sockets at the ends into the precise configuration required so that the bottom of the tray rests on the flange 140 in these sockets 142 in the relationship explained above. For the generally square horizontal tray 222 the support arms of U-shaped configuration 236 and 238 respectively, are opened up and they engage with the corner openings provided within the trays.

The relationship of the openings 125 to the corners is best seen in the illustration of the blank B of FIG. 14. Note that the tray 120 is cut from a single sheet of material and formed with flaps 121 and 123 at the corners of the outside wall portions 126 and 128 respectively, the lower of these numbers designating the front wall portion and the higher the rear wall portion, respectively. Thus flaps 121 extend from side wall portion 126. Flaps 123 extend from back wall 128. The wall portions are doubled by providing a fold-over edge both front and rear for walls 126 and 128, respectively. The side walls 130 of the blank are provided with slits 133 which are spaced apart to receive corresponding locking tabs 127 which are similarly spaced apart. By the simple process of folding inwardly the flaps 121 and 123 folding downwardly the front and rear wall extensions and downwardly the side wall tabs 127 to engage the slits 133 the tray is quickly set up.

Figure 1:
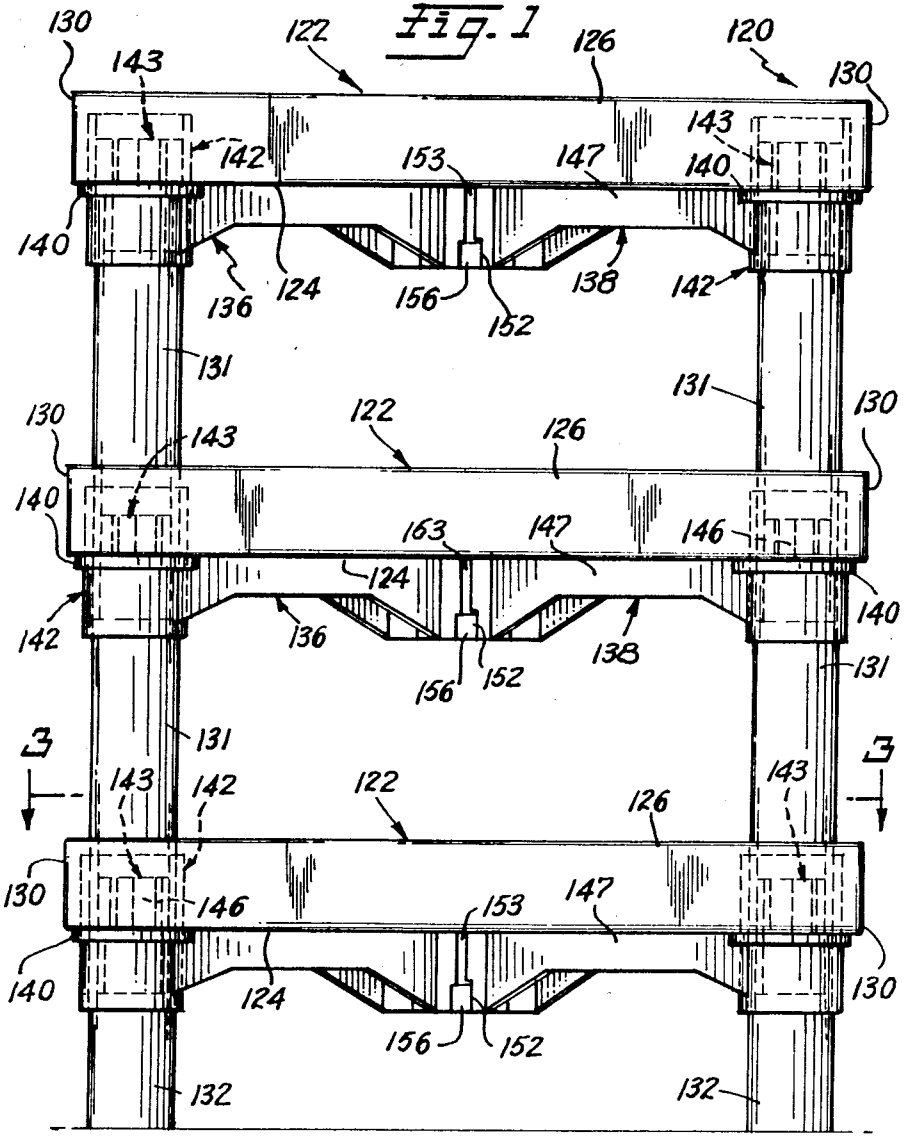
FIG. 1 is a front elevational view of the storage tray assembly of the present invention.

In the square shaped modification shown in FIGS. 14 and FIGS. 1–3, it will be seen that the circular openings 125 which are struck out are located at the corners of the tray and have the same dimensions as in the narrow oblong rectangular form of tray 222 shown in FIG. 13. The relationship of the diameter of the circular opening 125 in the floor of the tray is the same whether the tray is narrow and oblong as shown in FIG. 13 or square as shown in trays 120 and 122 in FIGS. 1–3. Reference numeral 120 is intended to refer to all of the trays in the assembled storage unit while the reference numeral 122 is intended to refer to a single tray and as shown in FIGS. 1 and 2 the trays are all identical.

From the foregoing, it is seen that the combinations of the standard circular openings permit the bottom 124 of the tray 122 to rest on the flange portion 140 of the socket 142 permits a stable and rigid configuration of the tray at the four corners while a diagonal cross reinforcement support is provided by the interpivoting channel-shaped arms 136 and 138 which are in inverted U-shaped configuration.

Figure 3:
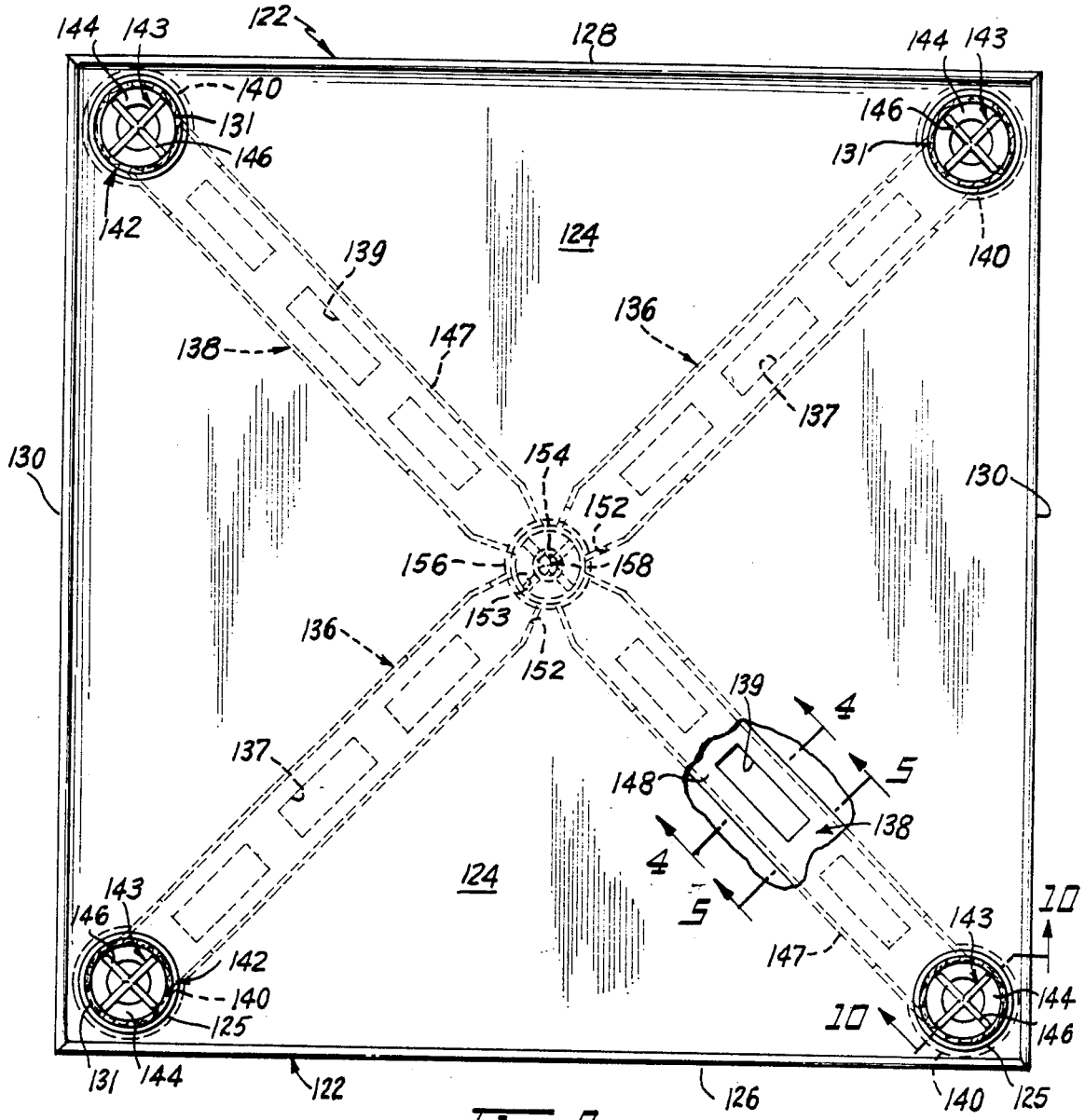
FIG. 3 is an enlarged horizontal sectional view of the storage tray assembly, taken on the line 3—3 of FIG. 1.
Figure 4:
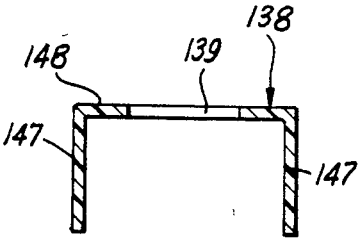
FIG. 4 is a vertical sectional view, through the adjustable channel shaped support arm, taken on the line 4—4 of FIG. 3.
Figure 6:
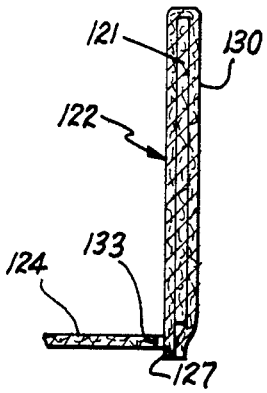
FIG. 6 is an enlarged fragmentary vertical sectional view through one side of a tray, taken on the line 6—6 of FIG. 2.
Figure 5:
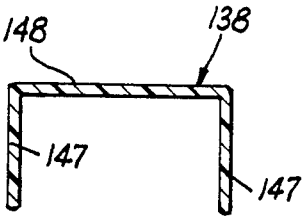
FIG. 5 is a vertical sectional view, similar to FIG. 4, taken on the line 5—5 of FIG. 3.

It will be appreciated that the U-shape is generally more rigid because of the geometric and thickness relationship of the depending sides 147 as shown in FIG. 4 which represent the vertical sides of U-shaped channel arm 138. FIG. 5 shows the depending side portions 147 in the cross-section which represents a portion of the channel shaped arms 138 which is uniformly solid in the upper shelf portion 143. In contrast, the oblong openings 139 which are provided serve to diminish the total weight without impairing the load bearing ability of the channel arm 138. Thus in the illustration in FIG. 3, three such oblong openings 139 are provided on each side of the pivot to provide a total of 6 such openings for the complete arm structure. Similarly, channel shaped arm 136 is formed with oblong openings 137 in the top shelf portion. Thus the X-bracing provided by the interpivoting arms 136 and 138, respectively, is accomplished by lightening the channel arms in the same manner without any sacrificing of the load bearing characteristics which constitutes a very important advantage of the invention over the adjustable knock-down tray assembly of my companion application, Ser. No. 639,045, filed Aug. 9, 1984.

Turning now to FIGS. 7 through 9, inclusive, which illustrates the new and unexpected advantages of the pivot structure where the arms 136 and 138 interfit it is first noted that the pivot construction is entirely different and far more stable in the present improved embodiment than in my companion application, Ser. No. 639,045 filed Aug. 9, 1984. First the U-shaped arm 138 is formed at its center with a hollow pivot boss 158 projecting above a circular side wall portion 156 wherein the height of the circular wall on the inside of 156 is one-half of the height of the upper socket portion which is provided in the pivot center of U-shaped channel arm 136. Since the pivot boss 158 accommodating the pin of U-shaped channel arm 138 is part of a pin and socket mechanism in which the socket is shown in an upside down relation to the pin and in which the downwardly projecting hollow boss 153 of the arm 136 has twice the height as the pin portion for the upwardly extending portion 156, a nesting relationship is achieved which assures a fit of the socket portion to the pin portion every time the two arms are brought together. To emphasize this locator function which is provided by the interfitting of the pivot portion represented by the upstanding hollow boss 156 and the downwardly projecting hollow boss 153 it is a very important feature of the invention that the upper socket rest on a wider shelf portion for the lower member 138. In short, and as shown in FIGS. 8 and 9, there is provided a more stable support by the unique extension in the lower shelf configuration represented by the interfit between the upstanding boss 154 in channel arm 136 and the pin portion for the lower arm 138. As a result of this improved fit shown in FIGS. 8 and 9 there is a significantly different configuration in the indentation and cut out portions 152. Since the upper socket portion at the pivot has a far greater depth there is a reciprocal limiting stop provided when the top channel member 136 is moved in the direction of the arrow towards the bottom channel member 138 as shown in FIG. 7. Comparing the opened view of FIG. 7 to the closed view of FIG. 13 for these arms 136 and 138 one quickly observes that there is no tendency for one arm 136 to move past the meeting of the indented trapezoidal sides. Accordingly the modification within the arms themselves to make the pin and the socket portions unsymmetrical contributes directly to improved stability.

The advantages in assembling and disassembling the elements are similar to those in my co-pending application Ser. No. 639,045 filed Aug. 9, 1984 but the improvement in load bearing capacity and the achievement of lightness because of the cut out portions 137 and 139 as shown in FIG. 3 results in a very significant display advantage, particularly for heavy objects. The improvement in load balancing capacity must be viewed separately and independently from the adaptability of the cross-arm support structure comprising arms 136 and 138 for the simple reason that display often does not require the presentation of heavy objects in retail store settings or industrial display settings where the objective is to permit the viewer to absorb as much visual information as possible. Thus, the objective in storage of objects using the improved adjustable knockdown tray assembly of the invention is to more efficiently use the support area for load bearing purposes, specifically the improvement of the present assembly 120 of FIG. 1 is to permit 100 pounds total of loading for the three trays. This contrasts with 75 pounds of total loading for the three trays of my copending application Ser. No. 639,045 filed Aug. 9, 1984. The increase in loading is 33⅓%, e.g. 25 pounds and equivalent to the provision of an additional area furnished by an added tray.

Figure 15:
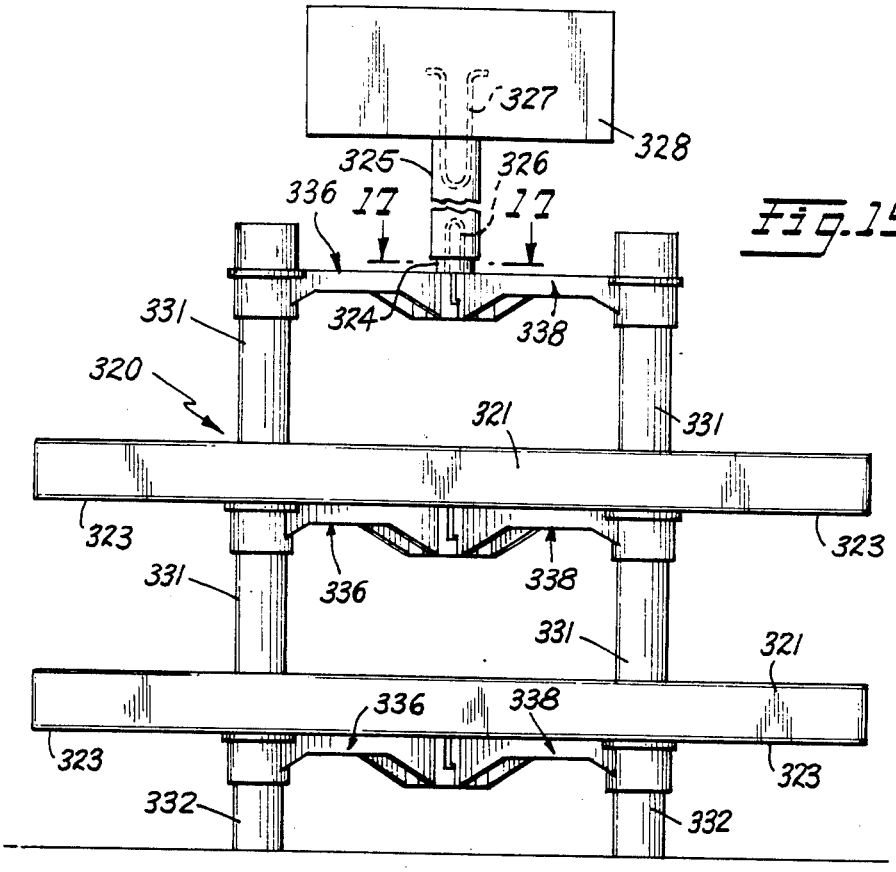
FIG. 15 is a front elevational view of a display modification showing the assembled display trays each having an elongated side shelf portion extending beyond the supporting posts and sockets and cut out portions in the bottom of the tray, the display modification being provided with a central post secured at the supporting pivotal arms for mounting a sign and post.

As shown in FIG. 15 illustrating a tray assembly 320 comprising two trays 321, each with its shelf portion 323 protruding beyond the support posts 331, the cross-arm support structures formed by arms 336 and 338 presents a pleasing and unique framework for the vertical posts 325 attached to the center portion of inverted U-shaped cross-arm 336. In this center portion which lies directly above the boss pivot part 153 the spider 143 is bored to provide two openings **326*a* which receive the open ends of the U-shaped wire 326**.

Figure 16:
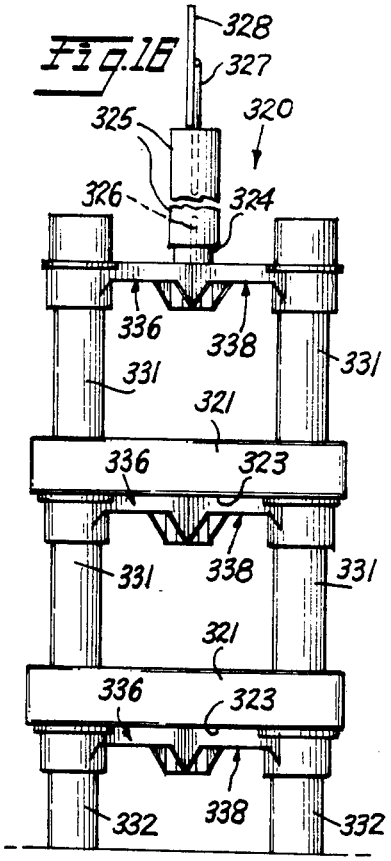
FIG. 16 is a side elevational view of the assembled tray of FIG. 15.
Figure 17:
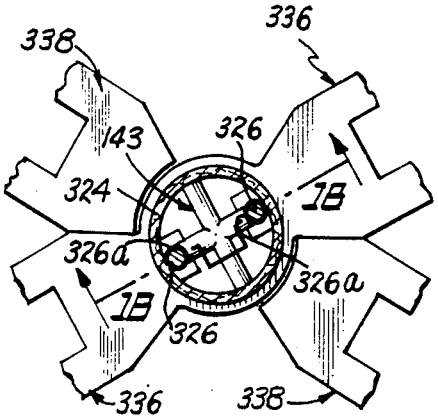
FIG. 17 is an enlarged fragmentary sectional view showing the attachment of the sign post to the center of one of the channel shaped arms, taken on the line 17—17 of FIG. 15.
Figure 18:
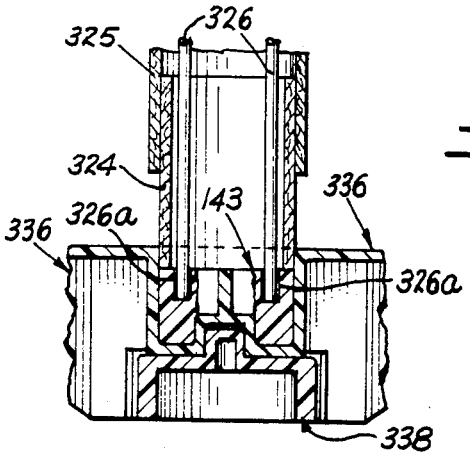
FIG. 18 is a sectional view along section line 18—18 of FIG. 17.

As shown in FIGS. 15 and 16 the upper ends of the wire 326 are bent to engage openings in the sign 328. This separate wire 327 is pushed into the top openings of the sign post 325 with the free ends protruding to engage the openings at the back of the sign 328. The nipple portion 324 at the bottom of the tubular post 325 is adapted to accomplish a secure frictional spring engagement by the legs of the U-shaped wire 326 at the bottom and in the embodiment shown in FIG. 15 the full diameter of the tubular upper part of the post 325 illustrates a wider wire support for the sign than the spread for the support at the bottom of the post 325. This is a matter of choice which illustrates a more stable support for the sign 328 in view of its length while a tighter support is accomplished at the bottom of the center post 325 by a greater degree of compression of the lower wire 326.

It will be appreciated that the substantial load carrying capacity of each of the two shelf portions 323 for each of the two trays 321 will permit practically any placement of the articles in this display modification.

Figure 19:
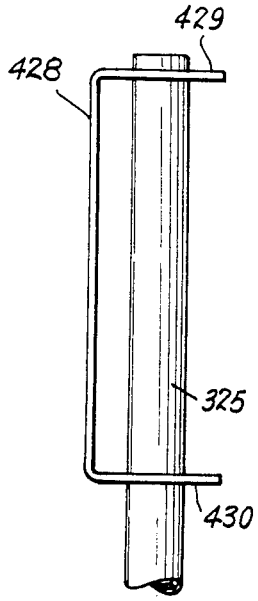
FIG. 19 is a fragmentary side elevational view of a modification of a sign and support post.

However, it is noted that the center post 325 need not have its attachment means confined simply to the inverted wire loop as shown by upper wire loop 327 in FIG. 15. Instead modification is shown in FIG. 19 in which the sign 428 is provided with a flange in the upper edge 429 and a flange in the lower edge 430. In this embodiment the post 325 is fitted through openings which conform to the outer periphery of the post 326 in each of the flanges 430 and 429, respectively. This embodiment illustrates a means to secure the upper part of the post 325 to the sign by fitting the post through the openings in the flange of the sign 428.

The four posts 332 which are shown in the bottom of the sockets in the display embodiment of FIG. 15 are about one half the height as the posts 331 to thereby permit the entire display assembly 320 to present a low and long appearance which is of special advantage in limited space for display, a common situation in smaller retail stores. The same relationship of one half height for posts 132 and 131 is shown in FIGS. 1 and 2 where no shelf portions are provided for the trays and the main purpose is for storage and most efficient use of space limited for that purpose.

From the foregoing description of the invention of the support structure having a vertical post for a sign as described in FIGS. 15–19, it will be understood that the utilization of the cross-arm support structure to support the vertical post 325 does not have to be limited to the two inverted U-channel members 136 and 138 or 336 and 338 of the present U-beam support system. The T-beam support system of my copending patent application, Ser. No. 639,045, filed Aug. 9, 1984, has a center construction for pivoting which is similar and it may be desirable to provide two bored holes in the upper T-beam center portion, specifically within the thickness of the wall portions 64 to engage the ends of a U-shaped wire. Accordingly, the U-shaped wire mounting means used in this sign post construction, U-shaped wire 326 may be similarly used with post 325 so that the ends of wire 326 enter the open nipple portion 324 of the sign post to serve to hold the sign post in an erect position for the mounting of a sign 328. This particular embodiment is not preferred in comparison with the present embodiment employing the U-beam members 336 and 338 as shown in FIG. 15 herein. Accordingly, the cross-arm structure useful for the sign post need not be limited to the U-channel members but can also be applicable to T-channel members or any channel members having sockets at the end.

What is claimed is:

1. A knockdown assembly adapted for storage and for display comprising:

a generally rectangular paperboard or cardboard tray having front and back walls and being made of a one-piece blank which is free from fastening elements having four uniformly spaced apart, cut-out circular portions adjacent the front and back walls thereof, the four cut-out portions being spaced apart to receive a tubular post at each cut-out portion and to receive a double socket on identical cross arms below the floor of the tray, the cross arms forming diagonal distances between the cut-out circular portions which are the same;

a tubular post at each cut-out circular portion;

a tray cross-arm support structure consisting of two inverted U-channel members each of the same length which are pivoted at their centers, one of said two channel arms having a pin and the other having a boss and each of said U-channel arms having a double socket at the corner into which said tubular post is fitted thereby adapting the tray cross-arm support structure to support the bottom of the tray and support any load placed on the tray;

said double socket which is provided at each corner of the two U-channel arms being adapted to receive at the upper end and at the lower end said tubular post to support in spaced apart relation a plurality of trays of the assembly;

said pin pivot member being provided at the center of a lower U-channel arm and having an elevation which is ½ of the elevation of the boss member which is provided in the other of said two channel arms thereby contributing to a stable pivotal interconnection at the pin and the boss and said U-channel member being provided with indented side and top portions near the center pivot location where the pin and boss engage.

2. A knockdown tray assembly for display purposes as claimed in claim 1 wherein said U-channel members are each provided with interrupted openings of rectangular uniform shape to provide rib portions transverse to the face of the U-shaped portion to lighten and strengthen said U-shaped channel arms.

3. A knockdown tray assembly as claimed in claim 2 wherein there are provided six rectangular openings, three on each side of the central pivot area.

4. A knockdown tray assembly adapted for display purposes as claimed in claim 1 comprising a plurality of trays each of which is long and narrow and each of which projects beyond the posts at each side together with a vertical standard secured to the top tray adapted to hold a sign identifying the goods to thereby adapt the goods and tray assembly as a display.

5. A knockdown tray assembly as claimed in claim 4 wherein said vertical standard is secured to the top tray by means of a loop holding device.

6. A knockdown tray assembly as claimed in claim 1 wherein the assembly comprises three cardboard trays which are spaced apart by tubular posts at each of the corners of each of the trays.

7. A knockdown tray assembly for display purposes as claimed in claim 4 wherein said assembly comprises three trays each of which projects beyond the posts at each side and wherein the top tray is secured to a vertical standard holding a sign identifying the goods for display.

* * * * *